US009865209B2

(12) United States Patent
Oh et al.

(10) Patent No.: US 9,865,209 B2
(45) Date of Patent: Jan. 9, 2018

(54) LIQUID CRYSTAL DISPLAY FOR OPERATING PIXELS IN A TIME-DIVISION MANNER

(75) Inventors: Daeseok Oh, Paju-si (KR); Saichang Yun, Daegu (KR); Minhwa Kim, Daegu (KR); Byeongseong So, Cheongju-si (KR); Seunghwan Shin, Seoul (KR); Youngsung Cho, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 924 days.

(21) Appl. No.: 13/312,492

(22) Filed: Dec. 6, 2011

(65) Prior Publication Data

US 2012/0139892 A1 Jun. 7, 2012

(30) Foreign Application Priority Data

Dec. 7, 2010 (KR) ..... 10-2010-0124287

(51) Int. Cl.
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2300/0452* (2013.01); *G09G 2310/0251* (2013.01)

(58) Field of Classification Search
USPC ..... 345/87, 88, 103, 694–696; 349/84, 149
See application file for complete search history.

(56) References Cited

U.S. PATENT DOCUMENTS

| | | | | |
|---|---|---|---|---|
| 5,151,689 | A * | 9/1992 | Kabuto et al. | 345/103 |
| 6,633,306 | B1 | 10/2003 | März et al. | |
| 6,980,186 | B2 * | 12/2005 | Nakano et al. | 345/88 |
| 7,961,205 | B2 * | 6/2011 | Park et al. | 345/695 |
| 8,044,905 | B2 * | 10/2011 | Kasahara | H01L 27/1214 257/202 |
| 2005/0259067 | A1 * | 11/2005 | Cheng | 345/103 |
| 2008/0068516 | A1 | 3/2008 | Mori et al. | |
| 2008/0106535 | A1 | 5/2008 | Kim et al. | |
| 2008/0198283 | A1 | 8/2008 | Yoon et al. | |
| 2008/0218647 | A1 | 9/2008 | Park | |
| 2010/0156947 | A1 | 6/2010 | Moon et al. | |
| 2010/0265225 | A1 | 10/2010 | Han et al. | |

FOREIGN PATENT DOCUMENTS

| | | | |
|---|---|---|---|
| DE | 198 11 022 | A1 | 9/1999 |
| DE | 10 2009 058 554 | A1 | 6/2010 |
| EP | 0 293 048 | A2 | 11/1988 |
| EP | 1 973 093 | A2 | 9/2008 |
| KR | 10-2008-0077807 | A | 8/2008 |

* cited by examiner

*Primary Examiner* — Ram Mistry
(74) *Attorney, Agent, or Firm* — Birch, Stewart, Kolasch & Birch, LLP

(57) ABSTRACT

A liquid crystal display is provided comprising an LCD panel including data lines formed along a column direction, gate lines formed along a row direction perpendicular to the column direction, and a plurality of pixels arranged in a matrix pattern at intersections of the data lines and the gate lines, a data driver that supplies data voltages to the data lines, and a gate driver that sequentially supplies gate pulses to the gate lines. Subpixels of each of the pixels share one data line through which a data voltage is sequentially charged to the subpixels in a time-division manner. A column-directional length of each of the subpixels is longer than a row-directional length of each of the subpixels.

7 Claims, 9 Drawing Sheets

LIQUID CRYSTAL DISPLAY FOR OPERATING PIXELS IN A TIME-DIVISION MANNER

This application claims the benefit of Korean Patent Application No. 10-2010-0124287 filed on Dec. 7, 2010, the entire contents of which is incorporated herein by reference for all purposes as if fully set forth herein.

BACKGROUND

Technical Field

The embodiments of this document are directed to a liquid crystal display.

Discussion of the Related Art

Referring to FIG. 1, which illustrates a structure of a pixel array in a conventional TRD (Triple Rate Driving) liquid crystal display, one pixel includes a red subpixel R, a green subpixel G, and a blue subpixel B that are arranged in parallel along a column direction (y-axis direction). Red subpixels R, green subpixels G, and blue subpixels B are respectively arranged on 3N+1th lines, 3N+2th lines, and 3N+3th lines, along a row direction (x-axis direction), wherein N is a positive integer). As shown in FIG. 1, in the conventional TRD liquid crystal display, a row-directional length of each subpixel is longer than a column-directional length of the subpixel. The conventional TRD liquid crystal display adopting such subpixel structure suffers from poor legibility, whose examples are shown in FIG. 2, which illustrates exemplary display results obtained by applying a clear type mode to the conventional TRD liquid crystal display.

SUMMARY

The embodiments of this document provide a liquid crystal display that may reduce the number of source drive ICs necessary for driving data lines together with enhanced legibility.

According to an embodiment of this document, there is provided a liquid crystal display comprising an LCD panel including data lines formed along a column direction, gate lines formed along a row direction perpendicular to the column direction, and a plurality of pixels arranged in a matrix pattern at intersections of the data lines and the gate lines, a data driver that supplies data voltages to the data lines, and a gate driver that sequentially supplies gate pulses to the gate lines.

Subpixels of each of the pixels share one data line through which a data voltage is sequentially charged to the subpixels in a time-division manner.

A column-directional length of each of the subpixels is longer than a row-directional length of each of the subpixels.

BRIEF DESCRIPTION OF THE DRAWINGS

The accompanying drawings, which are included to provide a further understanding of this document and are incorporated in and constitute a part of this specification, illustrate embodiments of this document and together with the description serve to explain the principles of this document. In the drawings.

DETAILED DESCRIPTION OF THE EMBODIMENTS

Figure 1:
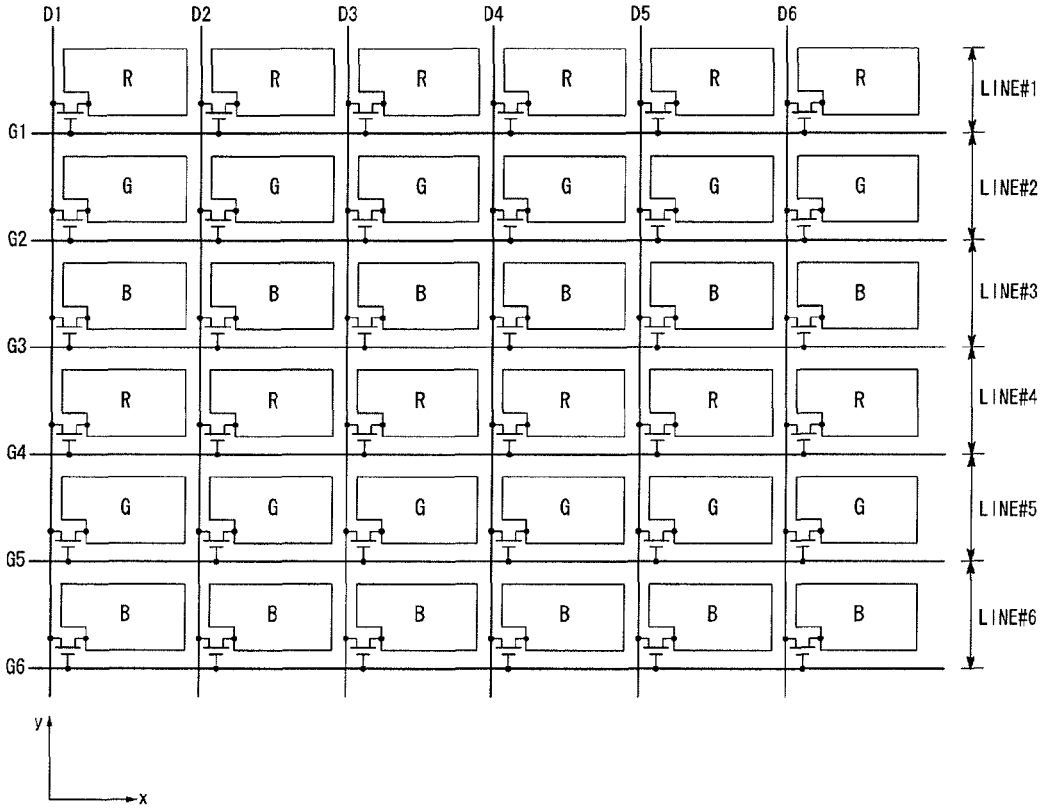
FIG. 1 (RELATED ART)
FIG. 1 is a view illustrating part of a pixel array of a conventional TRD liquid crystal display.
Figure 2:
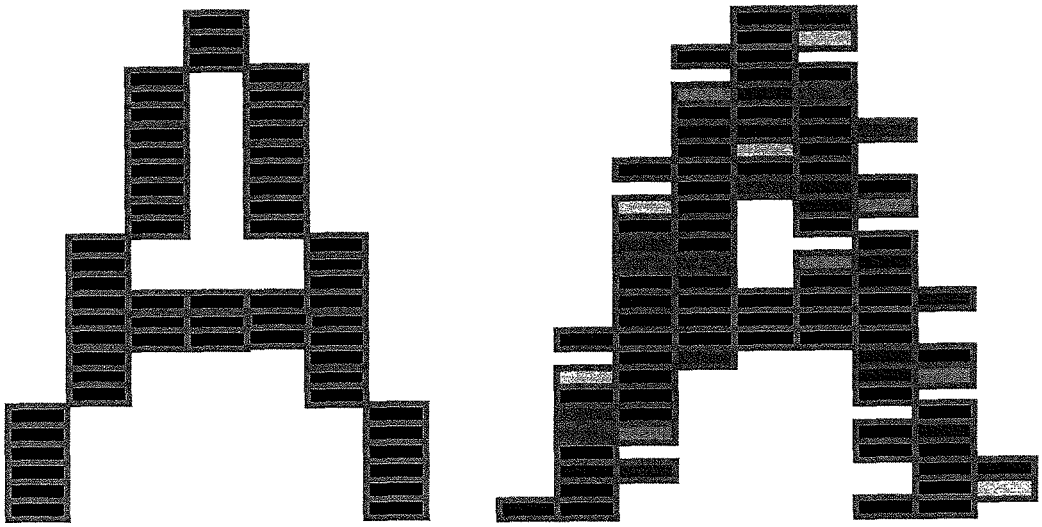
FIG. 2 (RELATED ART)
FIG. 2 is a view illustrating an experimental result of displaying letters on the pixels of FIG. 1 in clear type.

Hereinafter, exemplary embodiments of this document will be described with reference to the accompanying drawings, wherein the same reference numerals may be used to denote the same or substantially the same elements throughout the drawings and the specification. The description of well-known functions or structures, which makes the gist of this document unnecessarily unclear or equivocal, will be omitted.

Figure 3:
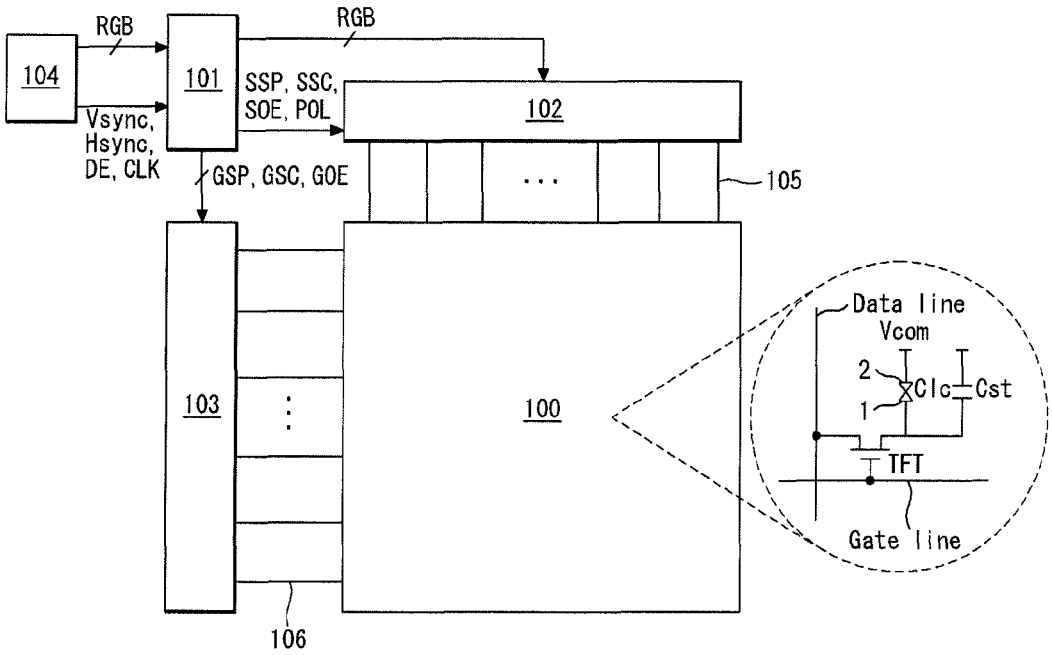
FIG. 3 is a block diagram illustrating a liquid crystal display according to an embodiment of this document.

Referring to FIG. 3, a liquid crystal display according to an embodiment includes a liquid crystal display (LCD) panel 100, a timing controller 101, a data driver 102, and a gate driver 103. The data driver 102 includes a plurality of source drive ICs.

Figure 4:
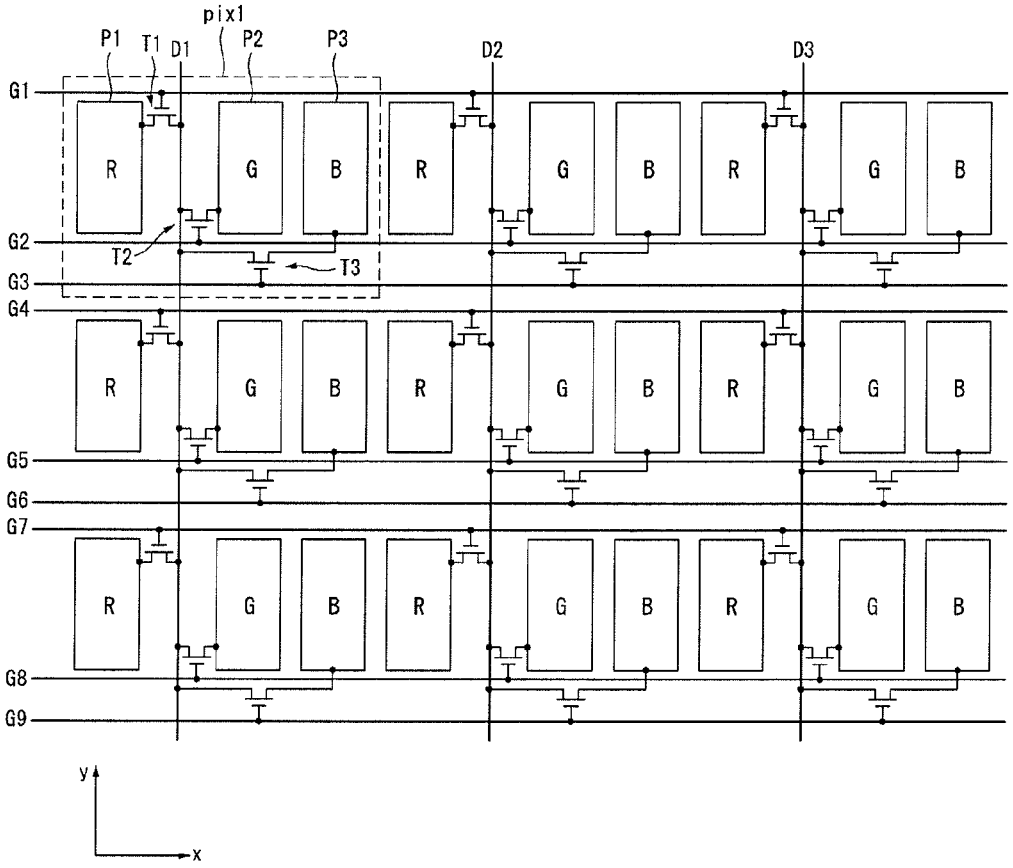
FIG. 4 is an equivalent circuit diagram illustrating part of a pixel array according to an embodiment of this document.
Figure 6:
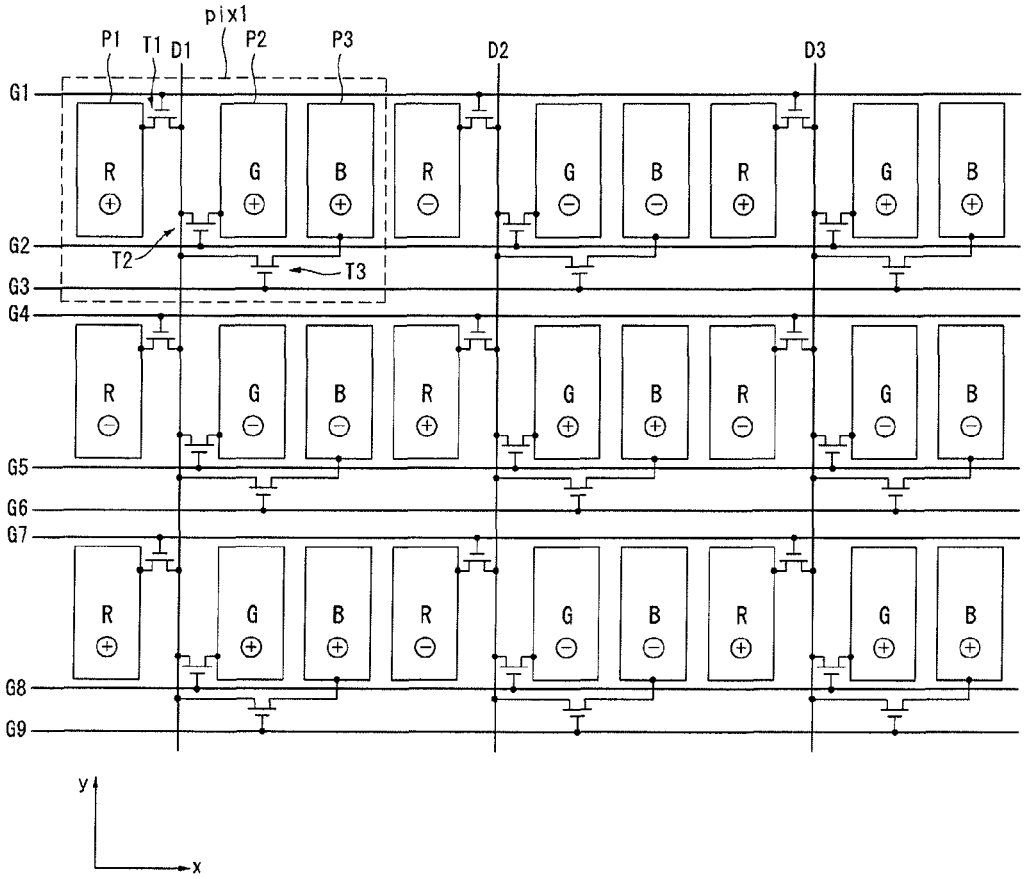
FIG. 6 is an equivalent circuit diagram illustrating an example where a horizontal three dot inversion mode applies to a liquid crystal display according to an embodiment of this document.
Figure 8:
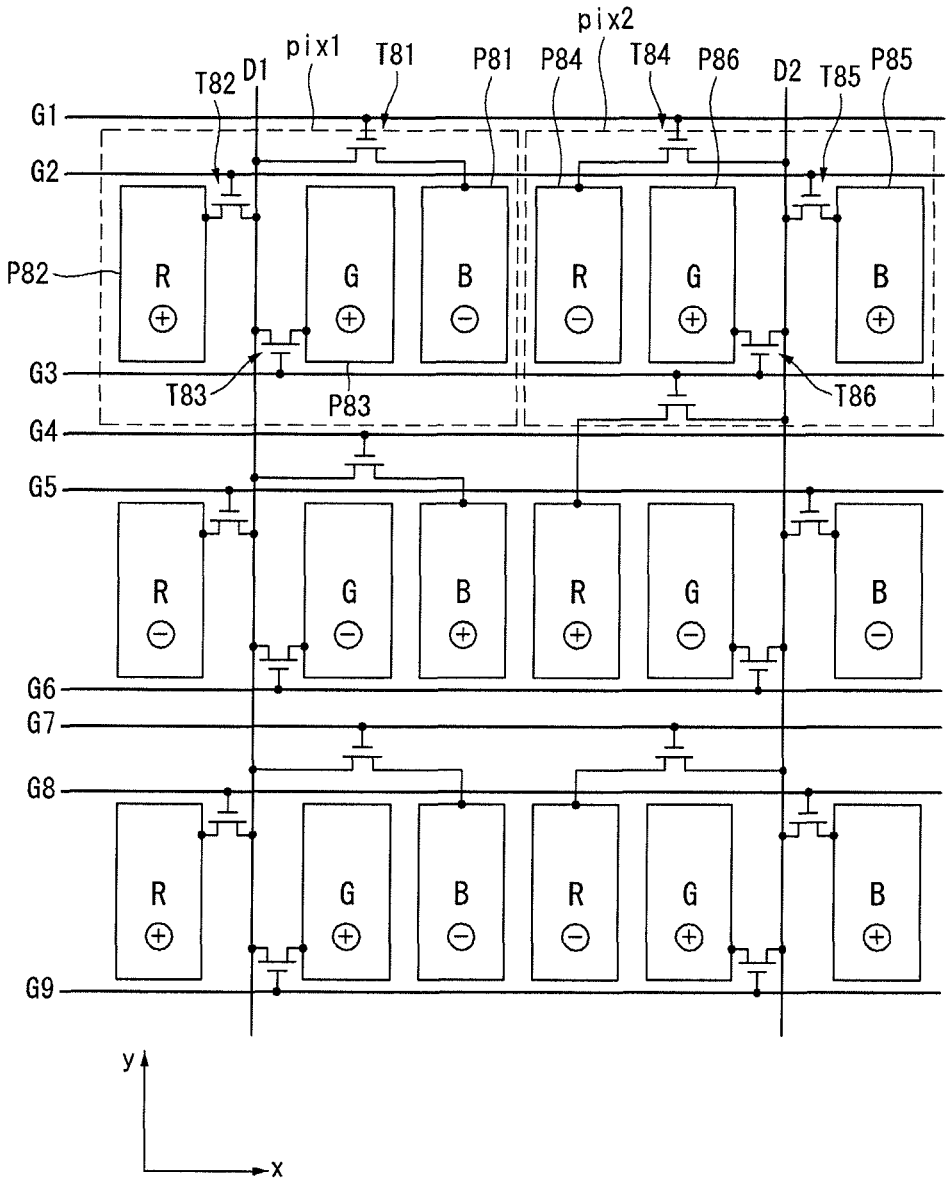
FIG. 8 is an equivalent circuit diagram illustrating a pixel array according to an embodiment of this document, wherein a horizontal two dot inversion mode applies to the pixel array.

The LCD panel 100 includes a liquid crystal layer between two glass substrates. The LCD panel 100 includes pixels that are arranged in a matrix pattern at intersections of data lines 105 and gate lines 106. The pixels of the LCD panel 100 may be arranged as shown in FIGS. 4, 6, and 8.

On a TFT array substrate of the LCD panel 100 are formed the data lines 105, the gate lines 106, TFTs, pixel electrodes 1 of liquid crystal cells Clc, and storage capacitors Cst. The gate lines 106 cross the data lines 105. The TFTs are provided at intersections of the data lines 105 and the gate lines 1006. The pixel electrodes 1 are connected to the TFTs, respectively. The storage capacitors Cst are connected to the pixel electrodes 1, respectively. The data lines 105 are formed in a column direction (y-axis direction), and the gate lines 106 are formed in a row direction (x-axis direction) perpendicular to the column direction.

The liquid crystal cells Clc are connected to the TFTs, respectively, and are driven by electric fields between the pixel electrodes 1 and a common electrode 2. The common electrode 2 is formed on the TFT array substrate and/or a color filter array substrate. On the color filter array substrate of the LCD panel 100 are formed black matrixes and color filters. A polarization plate is formed on each of the TFT array substrate and the color filter array substrate of the LCD panel 100. An alignment film is formed on a surface of each of the TFT array substrate and the color filter array substrate, which abuts the LCD layer, to set a pre-tilt angle of liquid crystal molecules.

The LCD panel 100 is driven in a vertical electric field driving method, such as a TN (Twisted Nematic) mode or a VA (Vertical Alignment) mode, or in a horizontal electric field driving method, such as an IPS (In Plane Switching) mode or an FFS (Fringe Field Switching) mode. According to embodiments, the liquid crystal display is implemented as a transmissive LCD, a transflective LCD, or a reflective LCD. The transmissive LCD or the transflective LCD requires a backlight unit. The backlight unit is implemented as a direct-type backlight unit or an edge-type backlight unit.

The timing controller 101 supplies digital video data for images input from the host system 104 to the data driver 102. The timing controller 101 receives timing signals including a vertical synchronization signal Vsync, a horizontal synchronization signal Hsync, a data enable signal DE, and a dot clock and generates timing control signals for controlling operation timing of the data driver 102 and the gate driver 103. The timing control signals include a gate timing control signal for controlling operation timing of the gate driver 103 and a data timing control signal for controlling operation timing of the data driver 102 and a polarity of a data voltage.

The gate timing control signal includes a gate start pulse GSP, a gate shift clock GSC, and a gate output enable GOE signal. The gate start pulse GSP is applied to a gate drive IC that generates a first gate pulse and controls the gate drive IC to produce the first gate pulse. The gate shift clock GSC is jointly input to the gate drive ICs and shifts the gate start pulse GSP. The gate output enable GOE signal controls output of the gate drive ICs.

The data timing control signal includes a source start pulse SSP, a source sampling clock SSC, a polarity control signal POL, and a source output enable SOE signal. The source start pulse SSP controls data sampling start timing of the data driver 102. The source sampling clock SSC controls data sampling timing for each of the source drive ICs based on a rising or falling edge. The source output enable SOE signal controls output timing of the data driver 102. The polarity control signal POL indicates timing that a data voltage output from the data driver 102 inverses its polarity.

The data driver 102 latches digital video data RGB input from the timing controller 101 in response to a data timing control signal. The data driver 102 converts the digital video data RGB into analogue positive/negative gamma compensation voltages in response to the polarity control signal POL, thereby generating positive/negative data voltages. The positive/negative data voltages output from the data driver 102 are supplied to the data lines 105. The source drive ICs of the data driver 102 are connected to the data lines 105 of the LCD panel 100 by a COG (Chip On Glass) process or by a TAB (Tape Automated Bonding) process.

The gate driver 103 sequentially supplies gate pulses to the gate lines 106 in synchronization with the data voltages in response to the gate timing control signals. The gate driver 103 is directly formed on the TFT array substrate of the LCD panel 100 by a GIP (Gate In Panel) process or is connected to the gate lines 106 of the LCD panel 100 by a TAB process.

FIG. 4 is an equivalent circuit diagram illustrating part of the pixel array of the LCD panel shown in FIG. 3, wherein D1 to D3 refer to data lines, and G1 to G9 refer to gate lines.

Referring to FIG. 4, a pixel includes a red subpixel R, a green subpixel G, and a blue subpixel G that are arranged in parallel along a row direction (or x-axis direction). Red subpixels R of the pixels are arranged every 3N+1th column in parallel along a column direction (or y-axis direction). Green subpixels G of the pixels are arranged every 3N+2th column in parallel along the column direction. Blue subpixels R of the pixels are arranged every 3N+3th column in parallel along the column direction.

In the pixel array shown in FIG. 4, subpixels RGB of one pixel share the same data line through which data voltages are supplied to the subpixels in a time-division manner and sequentially charged to the subpixels. As a consequence, the LCD according to the embodiments may decrease the number of the data lines 105 and the number of source drive ICs by ⅓ compared with the conventional LCD in which subpixels are connected to separate data lines, respectively.

Hereinafter, the structure of the pixel array shown in FIG. 4 is described in further detail.

A pixel electrode and a TFT for a red subpixel R are defined as a first pixel electrode P1 and a first TFT T1, respectively. A pixel electrode and a TFT for a green subpixel G are defined as a second pixel electrode P2 and a second TFT T2, respectively. A pixel electrode and a TFT for a blue subpixel B are defined as a third pixel electrode P3 and a third TFT T3, respectively. To drive the subpixels of the first pixel in a time-division manner, gate pulses are sequentially applied to the first to third gate lines G1 to G3.

The first TFT T1 supplies a red data voltage from the first data line D1 to the first pixel electrode P1 in response to a first gate pulse from the first gate line G1. The gate electrode of the first TFT T1 is connected to the first gate line G1, and the drain electrode of the first TFT T1 is connected to the first data line D1. The source electrode of the first TFT T1 is connected to the first pixel electrode P1. The second TFT T2 supplies a data voltage from the first data line D1 to the second pixel electrode P2 in response to a second gate pulse from the second gate line G2. The gate electrode of the second TFT T2 is connected to the second gate line G2, and the drain electrode of the second TFT T2 is connected to the first data line D1. The source electrode of the second TFT T2 is connected to the second pixel electrode P2. The third TFT T3 supplies a data voltage from the first data line D1 to the third pixel electrode P3 in response to a third gate pulse from the third gate line G3. The gate electrode of the third TFT T3 is connected to the third gate line G3, and the drain electrode of the third TFT T3 is connected to the first data line D1. The source electrode of the third TFT T3 is connected to the third pixel electrode P3.

Referring to FIG. 4, the first gate line G1 is disposed over the pixels, and the second and third gate lines G2 and G3 are disposed under the pixels. However, the embodiments of this document are not limited thereto. For example, according to an embodiment, all of the first to third gate lines G1, G2, and G3 are disposed under the pixels.

Figure 5:
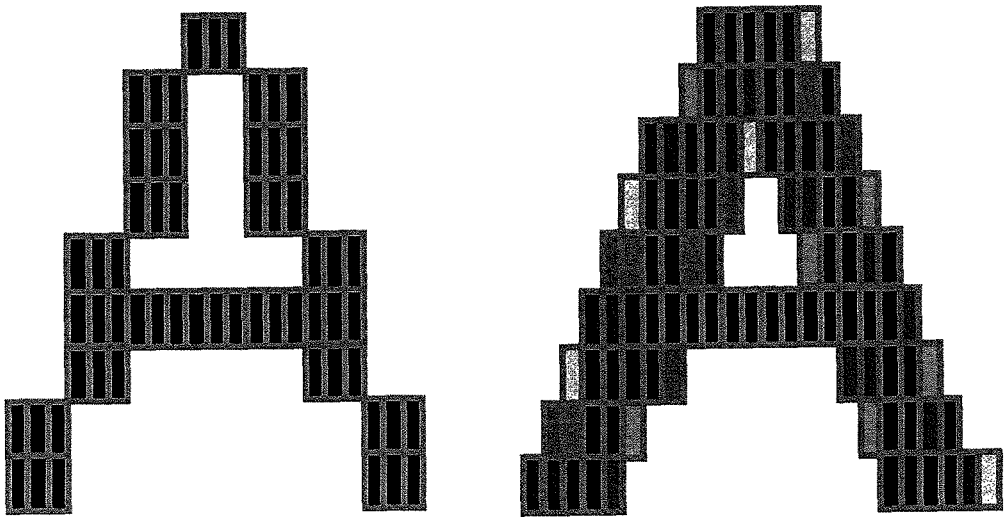
FIG. 5 is a view illustrating an experimental result of displaying letters on a liquid crystal display having the pixel array of FIG. 4 in clear type.

As shown in FIG. 4, a column-directional length of each subpixel is longer than a row-directional length of the subpixel. Such a subpixel structure allows for enhanced legibility when the pixel array shown in FIG. 4 displays tiny text as can be seen from a comparison between FIG. 1 and FIG. 5.

In liquid crystal displays, polarities of data voltages are driven in a N dot-inversion mode (N is a natural number) to reduce a deterioration of the liquid crystal layer and after-images. FIGS. 6 to 9 show an exemplary dot-inversion mode performed in a liquid crystal display according to an embodiment of this document.

Figure 7:
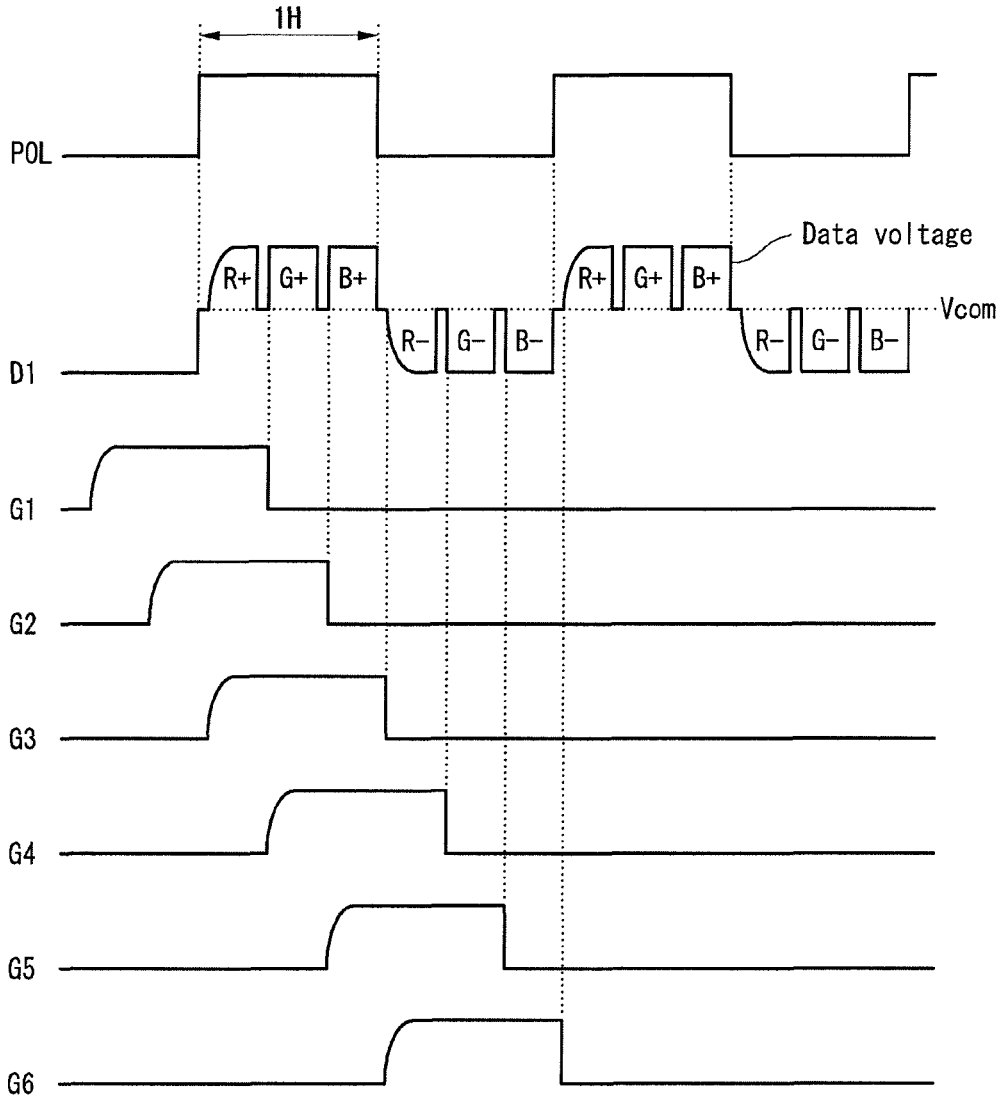
FIG. 7 is a waveform diagram illustrating data voltages and gate pulses for implementing the dot inversion mode shown in FIG. 6.

FIG. 6 is an equivalent circuit diagram illustrating an example where a horizontal three dot inversion mode applies to a liquid crystal display according to an embodiment of this document. FIG. 7 is a waveform diagram illustrating data voltages and gate pulses for implementing the dot inversion mode shown in FIG. 6.

Referring to FIGS. 6 and 7, a polarity control signal POL is inversed at one horizontal period. The one horizontal period refers to one line scanning time during which data are written in pixels of one display line in the LCD panel 100. The polarity control signal POL inverses its phase every frame to inverse polarities of data voltages charged to the pixels at every frame period. The source drive ICs inverse polarities of the data voltages supplied to the data lines D1 to D3 in response to the polarity control signal POL. Each data voltage is supplied to the data line during about ⅓ horizontal period.

To compensate for a relatively insufficient pixel charging time, the gate driver 103 sequentially supplies gate pulses, each having a pulse width of substantially one horizontal period, to the gate lines G1 to G9. An nth gate pulse (n is a natural number) overlaps an n−1th gate pulse by about ⅔ pulse width, and the nth gate pulse overlaps an n+1th gate pulse by about ⅔ pulse width.

After pre-charged with two data voltages, the pixels are charged with a data voltage which desires to be displayed and maintains the charged data voltage during one frame period. For example, in FIG. 6, the blue subpixel B of the first pixel is precharged with red and green data voltages R+ and G+, which are positive data voltages, and is then charged with a blue data voltage B+ which is a positive data voltage as desired to be displayed, and sustains the blue data voltage B+ for substantially one frame period.

In FIG. 6, data voltages supplied to odd-numbered data lines D1 and D3 and a data voltage supplied to an even-numbered data line D2 have different polarities. The polarities of the data voltages supplied to the odd-numbered and even-numbered data lines D1 and D3, and D2 are inversed every one horizontal period. Accordingly, data voltages charged to subpixels of the first pixel are positive data voltages, and data voltages charged to subpixels of a second pixel adjacent to the first pixel along the same display line as the first pixel are negative data voltages. As a result, the pixel array shown in FIG. 6 is operated in a horizontal three dot and vertical one dot inversion mode. For example, the pixel array shown in FIG. 6 performs inversion every three dots along the horizontal direction and every dot along the vertical direction.

A current from the source drive IC increases as transition occurs from a positive data voltage to a negative data voltage or from a negative data voltage to a positive data voltage. Accordingly, power consumption of the source drive IC increases as the number of times of transition between voltages having different polarities increases. Since three consecutive data voltages have the same polarity as shown in FIG. 7, the liquid crystal display according to the embodiments of this document can reduce power consumption to less than about ⅓ of power consumption of the conventional liquid crystal display.

Figure 9:
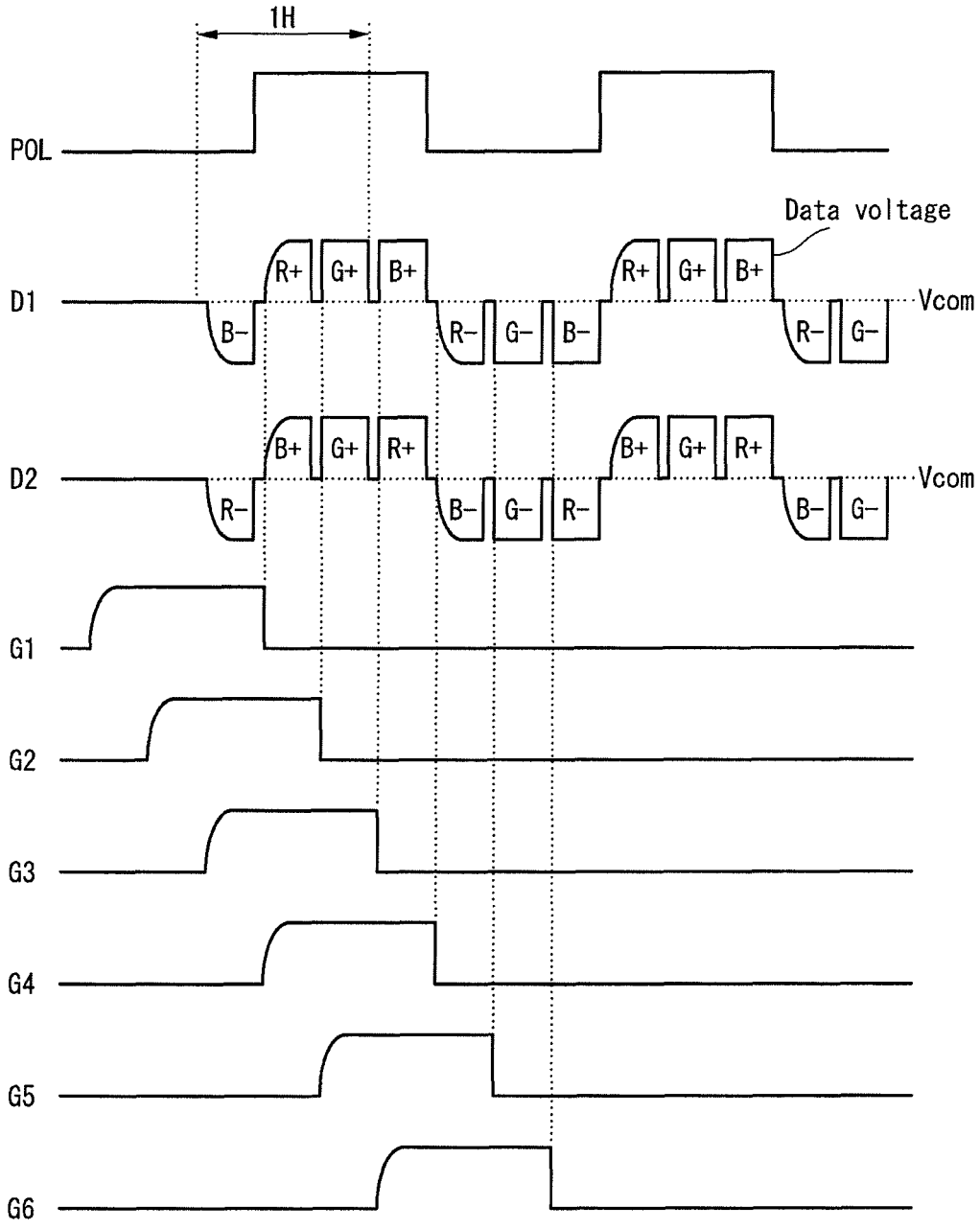
FIG. 9 is a waveform diagram illustrating data voltages and gate pulses for implementing the dot inversion mode shown in FIG. 8.

FIG. 8 is an equivalent circuit diagram illustrating a pixel array according to an embodiment of this document, wherein a horizontal two dot inversion mode applies to the pixel array. In FIG. 8, D1 and D2 refer to data lines, and G1 to G9 refer to gate lines. FIG. 9 is a waveform diagram illustrating data voltages and gate pulses for implementing the dot inversion mode shown in FIG. 8.

Referring to FIG. 8, a pixel includes a red subpixel R, a green subpixel G, and a blue subpixel G that are arranged in parallel along the row direction (x-axis direction). Red subpixels R of the pixels are arranged every 3N+1th column in parallel along a column direction (or y-axis direction). Green subpixels G of the pixels are arranged every 3N+2th column in parallel along the column direction. Blue subpixels R of the pixels are arranged every 3N+3th column in parallel along the column direction.

In the pixel array shown in FIG. 8, subpixels RGB of one pixel share the same data line through which data voltages are supplied to the subpixels in a time-division manner and sequentially charged to the subpixels. As a consequence, the LCD according to the embodiments may decrease the number of the data lines 105 and the number of source drive ICs by ⅓ compared with the conventional LCD in which subpixels are connected to separate data lines, respectively.

Hereinafter, the structure of the pixel array shown in FIG. 8 is described in further detail.

With respect to a data charging order in the first pixel pix1, a pixel electrode and a TFT for a blue subpixel B are defined as a first pixel electrode P81 and a first TFT T81, respectively, a pixel electrode and a TFT for a red subpixel R are defined as a second pixel electrode P82 and a second TFT T82, respectively, and a pixel electrode and a TFT for a green subpixel G are defined as a third pixel electrode P83 and a third TFT T83, respectively. With respect to a data charging order in the second pixel pix2, a pixel electrode and a TFT for a red subpixel R are defined as a fourth pixel electrode P84 and a fourth TFT T84, respectively, a pixel electrode and a TFT for a blue subpixel B are defined as a fifth pixel electrode P85 and a fifth TFT T85, respectively, and a pixel electrode and a TFT for a green subpixel G are defined as a sixth pixel electrode P86 and a sixth TFT T86, respectively.

The first TFT T81 supplies a negative data voltage B− from the first data line D1 to the first pixel electrode P81 in response to a first gate pulse from the first gate line G1. The gate electrode of the first TFT T81 is connected to the first gate line G1, and the drain electrode of the first TFT T81 is connected to the first data line D1. The source electrode of the first TFT T81 is connected to the first pixel electrode P81. The second TFT T82 supplies a positive data voltage R+ from the first data line D1 to the second pixel electrode P82 in response to a second gate pulse from the second gate line G2. The gate electrode of the second TFT T82 is connected to the second gate line G2, and the drain electrode of the second TFT T82 is connected to the first data line D1. The source electrode of the second TFT T82 is connected to the second pixel electrode P82. The third TFT T83 supplies a positive data voltage G+ from the first data line D1 to the third pixel electrode P83 in response to a third gate pulse from the third gate line G3. The gate electrode of the third TFT T83 is connected to the third gate line G3, and the drain electrode of the third TFT T83 is connected to the first data line D1. The source electrode of the third TFT T83 is connected to the third pixel electrode P83.

The fourth TFT T84 supplies a negative data voltage R− from the second data line D2 to the fourth pixel electrode P84 in response to the first gate pulse from the first gate line G1. The gate electrode of the fourth TFT T84 is connected to the first gate line G1, and the drain electrode of the fourth TFT T84 is connected to the second data line D2. The source electrode of the fourth TFT T84 is connected to the fourth pixel electrode P84. The fifth TFT T85 supplies a positive data voltage B+ from the second data line D2 to the fifth pixel electrode P85 in response to the second gate pulse from the second gate line G2. The gate electrode of the fifth TFT T85 is connected to the second gate line G2, and the drain electrode of the fifth TFT T85 is connected to the second data line D2. The source electrode of the fifth TFT T85 is connected to the fifth pixel electrode P85. The sixth TFT T86 supplies a positive data voltage G+ from the second data line D2 to the sixth pixel electrode P86 in response to the third gate pulse from the third gate line G3. The gate electrode of the sixth TFT T86 is connected to the third gate line G3, and the drain electrode of the sixth TFT T86 is connected to the second data line D2. The source electrode of the sixth TFT T86 is connected to the sixth pixel electrode P86.

Referring to FIG. 8, the first and second gate lines G1 and G2 are disposed over the pixels, and the third gate line G3 is disposed under the pixels. However, the embodiments of this document are not limited thereto. For example, according to an embodiment, the gate lines are disposed as shown in FIG. 4, or all of the first to third gate lines G1, G2, and G3 are disposed over or under the pixels.

As shown in FIG. 8, a column-directional length of each subpixel is longer than a row-directional length of the subpixel. Such a subpixel structure allows for enhanced legibility when the pixel array shown in FIG. 4 displays tiny text as can be seen from a comparison between FIG. 1 and FIG. 5.

To implement a horizontal two dot inversion mode, the polarity control signal POL, the data voltages, and gate pulses are generated as shown in FIG. 9.

Referring to FIGS. 8 and 9, the polarity control signal POL is inversed at one horizontal period. The polarity control signal POL inverses its phase every frame to inverse polarities of data voltages charged to the pixels at every frame period. The source drive ICs inverse polarities of the data voltages supplied to the data lines D1 to D3 in response to the polarity control signal POL. Each data voltage is supplied to the data line during about ⅓ horizontal period.

To compensate for a relatively insufficient pixel charging time, the gate driver 103 sequentially supplies gate pulses, each having a pulse width of substantially one horizontal period, to the gate lines G1 to G9. An nth gate pulse (n is a natural number) overlaps an n−1th gate pulse by about ⅔ pulse width, and the nth gate pulse overlaps an n+1th gate pulse by about ⅔ pulse width.

After pre-charged with two data voltages, the pixels are charged with a data voltage which desires to be displayed and maintains the charged data voltage during one frame period. For example, in FIG. 8, the green subpixel G of the first pixel PIX1 is precharged with a blue data voltage B−, which is a negative data voltage, and a red data voltages R+, which is a positive data voltage, and is then charged with a green data voltage G+ which is a positive data voltage as desired to be displayed, and sustains the green data voltage G+ for substantially one frame period.

In FIG. 8, among the data voltages charged to the first pixel pix1, the first data voltage has a different polarity from polarities of the second and third data voltages, and among the data voltages charged to the second pixel pix2, the first data voltage has a different polarity from polarities of the second and third data voltages. The data voltages supplied to the first and second data lines D1 and D2 have the same polarity which is inversed every one frame. As a consequence, the pixel array shown in FIG. 8 is operated in a horizontal two dot and vertical one dot inversion mode. For example, the pixel array shown in FIG. 8 performs inversion every two dots along the horizontal direction and every dot along the vertical direction.

Since three consecutive data voltages have the same polarity as shown in FIG. 9, the liquid crystal display according to the embodiments of this document can reduce power consumption to less than about ⅓ of power consumption of the conventional liquid crystal display.

As described above, according to the embodiments of this document, subpixels of each pixel share one data line through which data voltages supplied in a time-division manner are charged to the subpixels. In each subpixel, a column-directional length is longer than a row-directional length. As a consequence, the embodiments of this document can reduce the number of source drive ICs required for driving data lines on the LCD panel and can enhance legibility.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

an LCD panel including data lines formed along a column direction, gate lines formed along a row direction perpendicular to the column direction, and a plurality of pixels arranged in a matrix pattern, wherein the pixels include a first pixel and a second pixel, and each of the pixels includes a first subpixel, a second subpixel and a third subpixel, wherein the first subpixel of the first pixel and the first subpixel of the second pixel have a first color, wherein the second subpixel of the first pixel and the second subpixel of the second pixel have a second color different from the first color, wherein the third subpixel of the first pixel and the third subpixel of the second pixel have a third color different from the first color and the second color, wherein subpixels of each of the pixels share one data line through which first, second and third data voltages are sequentially charged to the subpixels in a time-division manner, wherein the data lines include a first data line connected to the subpixels of the first pixel, and a second data line connected to the subpixels of the second pixel, wherein the gate lines include:

a first gate line directly connected to the third subpixel of the first pixel and to the first subpixel of the second pixel, a second gate line directly connected to the first subpixel of the first pixel and to the third subpixel of the second pixel, and a third gate line directly connected to the second subpixels of the first and second pixels, respectively, wherein the first to third gate lines are sequentially supplied with first to third gate pulses, respectively, and wherein:

the first data voltages supplied to the third subpixel of the first pixel and the first subpixel of the second pixel in synchronization with the first gate pulse have a first polarity, and the second data voltages supplied to the first subpixel of the first pixel and the third subpixel of the second pixel in synchronization with the second gate pulse and the third data voltages supplied to the second subpixel of the first pixel and the second subpixel of the second pixel in synchronization with the third gate pulse have a second polarity.

2. The liquid crystal display of claim 1, wherein the subpixels of each pixel are arranged in parallel along the row direction, and wherein subpixels having the same color are arranged adjacent to each other along the column direction.

3. The liquid crystal display of claim 1, wherein the pixels include the first pixel to which the first to third data voltages are charged that are supplied through the first data line in the time-division manner, and wherein the first pixel comprises:

a first TFT that supplies the first data voltage from the first data line to a first pixel electrode in response to a first gate pulse from the first gate line;

a second TFT that supplies the second data voltage from the first data line to a second pixel electrode in response to a second gate pulse from the second gate line; and a third TFT that supplies the third data voltage from the first data line to a third pixel electrode in response to a third gate pulse from the third gate line.

4. The liquid crystal display of claim 3, wherein the first data voltage has a different polarity from polarities of the second and third data voltages.

5. The liquid crystal display of claim 1, wherein the first and second gate lines are disposed over the first and second pixels, and the third gate line is disposed under the first and second pixels.

6. The liquid crystal display of claim 1, wherein in each subpixel, a column-directional length is longer than a row-directional length to reduce a number of source drive ICs required for driving the data lines on the LCD panel.

7. A liquid crystal display comprising:

an LCD panel including data lines formed along a column direction, gate lines formed along a row direction perpendicular to the column direction, and a plurality of pixels arranged in a matrix pattern, wherein the pixels include a first pixel and a second pixel, and each of the pixels includes a first subpixel having a first color, a second subpixel having a second color and a third subpixel having a third color, wherein subpixels of each of the pixels share one data line through which first, second and third data voltages are sequentially charged to the subpixels in a time-division manner, wherein the data lines include a first data line connected to the subpixels of the first pixel, and a second data line connected to the subpixels of the second pixel, wherein the gate lines include:

a first gate line directly connected to the third subpixel of the first pixel and to the first subpixel of the second pixel, a second gate line directly connected to the first subpixel of the first pixel and to the third subpixel of the second pixel, and a third gate line directly connected to the second subpixels of the first and second pixels, wherein the first to third gate lines are sequentially supplied with first to third gate pulses, respectively, and wherein the first and second gate lines are disposed over the first and second pixels, and the third gate line is disposed under the first and second pixels.

* * * * *